United States Patent [19]

Vulcano et al.

[11] 4,253,290

[45] Mar. 3, 1981

[54] AUTOMATIC BAGGING MACHINE

[76] Inventors: Vincent N. Vulcano, 301 E. 48th St., New York, N.Y. 10017; Maurice W. Friedman, 548 Barnard Ave., Woodmere, N.Y. 11598

[21] Appl. No.: 25,208

[22] Filed: Mar. 29, 1979

[51] Int. Cl.[3] ..... B65B 5/02

[52] U.S. Cl. ..... 53/256

[58] Field of Search ..... 53/241, 256, 551, 552

[56] References Cited

U.S. PATENT DOCUMENTS

| | | | |
|---|---|---|---|
| 3,023,558 | 3/1962 | Mitchell | 53/241 |
| 3,045,403 | 7/1962 | Mitchell | 53/552 X |
| 3,895,480 | 7/1975 | Lombardo | 53/241 X |
| 3,982,377 | 9/1976 | Vanderpool | 53/241 X |

FOREIGN PATENT DOCUMENTS

| | | | |
|---|---|---|---|
| 1277043 | 10/1961 | France | 83/139 |

*Primary Examiner*—Travis S. McGehee

*Attorney, Agent, or Firm*—Stephen E. Feldman; Marvin Feldman

[57] ABSTRACT

An apparatus for automatically forming bags on hanger suspended garments comprises a plurality of stands for supporting hangers with garments suspended therefrom. A device is provided to move each of the plurality of stands in sequence to at least first, second and third positions. Each of the stands remains stationary for a brief interval at each of the positions following its arrival. Each of the stands is adapted to have a hanger suspended garment mounted thereon when each stand is at the first position. An adjustable placing apparatus is provided at the second position for pulling tubular material along a path. A cutting device above the garment moves toward the material to cut the tubular material and away from the material to permit pulling down of additional tubular material. A sealing device above the stands moves towards the material to seal the tubular material and moves away from the material to permit pulling down of additional tubular material. The sealing device includes a sealing element which is heated to a heat sealing temperature during the movement towards the material and to a lower non-sealing temperature during the movement away from the material.

16 Claims, 6 Drawing Figures

AUTOMATIC BAGGING MACHINE

BACKGROUND OF THE INVENTION

While the invention is subject to a wide range of applications, it is especially suited for use in an apparatus for placing transparent plastic bags over garments and will be particularly described in that connection.

Bagging machines which operate in either an automatic or semi-automatic manner to place transparent plastic tubes over garments and to cut and seal such tubes so as to form garment bags for garments have been known for several years. In general there prior art machines are excessively complex from both a mechanical and electrical point of view, and therefore are usually subject to excessive "down" time, and are also quite expensive so that they cannot be as a practical manner utilized by garment manufacturers. Further, in main these prior art bagging machines cannot be used or are quite difficult to use on transparent plastic tubular material of different diameters or of different film thicknesses. These prior art machines tear this plastic tubular material, so that they must be restored to proper working condition by an operator. Still further, in general these prior art bagging machines did not have an adequate capability for forming transparent bags of a length which is adjustable as a function of the length of the garment to be bagged.

In general, these problems presented in the prior art machines have been solved by U.S. Pat. No. 4,094,128 to Vulcano and Friedman which states, for example, "The present invention relates to apparatus for continuously and automatically placing length of transparent plastic tubes from a supply of plastic tubular material, over garments and cutting and sealing these plastic tubes so as to form garment bags for such garments on an individual basis." This patent which issued to the present invention was modified according to the present invention and is incorporated as to the common subject matter in this specification. The automatic bagging machine as set forth in the above-mentioned patent, occasionally had problems with the plastic tubular material sticking to the sealing mechanism, slightly irregular severing of the material by the cutting blade, difficulty in adjusting various mechanical components of the bagging machine and limited speed of operation.

Accordingly, it is the primary object of the present invention to provide an apparatus for bagging garments which substantially obviates one or more of the limitations and disadvantages of the described prior arrangement.

It is a further object of the present invention to provide an automatic bagging apparatus which has an improved sealing mechanism that prevents the plastic material from sticking to the sealing device.

It is a still further object of the present invention to provide an automatic bagging apparatus of the character described which has an improved cutting device which uniformly cuts the tubular bagging material.

It is yet another object of the present invention to provide an automatic bagging apparatus of the character described which has the capacity to operate on tubular plastic material of different widths of an easy adjustment of the apparatus by an operator.

It is yet another object of the present invention to an automatic bagging apparatus of the character described which is able to operate at relatively fast speeds.

It is yet a further object of the present invention to provide an automatic bagging apparatus of the character described which is relatively compact.

SUMMARY OF THE INVENTION

In general, and in accordance with the principals of the present invention, there is provided an apparatus for automatically bagging garments. The apparatus includes a plurality of stands for supporting hangers with garments suspended therefrom. A device moves each of the plurality of stands in sequence to at least first, second, and third positions. Each of the stands remains stationary for a brief interval at each of the positions following its arrival thereat. The stands are adapted to have a hanger suspended garment mounted thereon when the stand is at the first position. Adjustable placing apparatus is provided at the second position for pulling down tubular material along a path. A cutting device above the garment moves towards the material to cut the tubular material and away from the material to permit pulling down of additional tubular material. A sealing device above the stands moves toward the material to seal the material and away from the material to permit pulling down of additional material. The sealing device includes a sealing element which is heated to a heat sealing temperature during the movement towards the material and to lower non sealing temperature during the movement away from the material. The sealing device includes a non-stick surface which contacts the plastic tubular material when the material is being sealed. Adjustable placing device includes structure for gripping the leading edge of the tubular material which is easily adjustable to different positions.

For a better understanding of the present invention, together with other and further objects thereof, reference is had to the following description, taken in connection with the accompanying drawings while its scope will be pointed out in the appended claims.

DESCRIPTION OF THE PREFERRED EMBODIMENT

Figure 1:
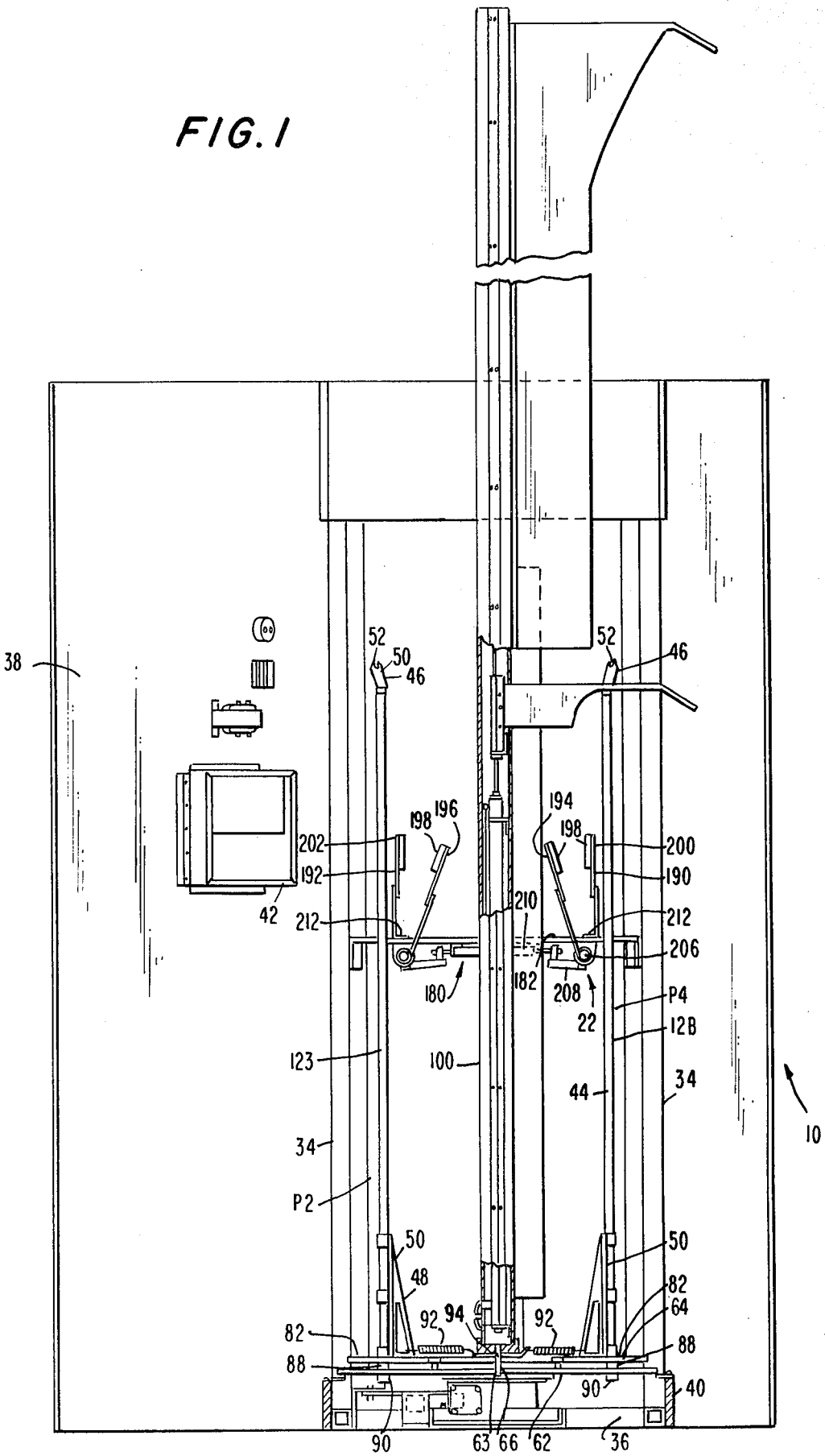
FIG. 1 is a front view of an automatic backing machine in accordance with the present invention.

There is provided an apparatus for automatically forming bags on hanger suspended garments comprising a plurality of stands 12A, 12B, 12C and 12D for supporting hangers 13 with garments suspended therefrom. A device 14 moves each of the plurality of stands in sequence to at least first, second, and third positions (16, 18, and 20 respectively). Each of the stands remains stationary for a brief interval at each of the positions following its arrival thereat. Each of the stands is adapted to have a hanger suspended garment mounted thereon when it is at the first position 16. An adjustable placing apparatus 22 at the second position 18 pulls down the tubular material 23 along a path. A cutting device 24 above the garment moves toward the material 23 to cut the material and away from the material to permit pulling down of additional tubular material. A sealing device 26 above the garment moves towards the material to seal the tubular material and away from the material to permit pulling down of additional tubular material. The sealing device 26 includes a sealing element 28 which is heated to a heat sealing temperature during the movement towards the material and to a lower non-sealing temperature during the movement away from the material.

Figure 2:
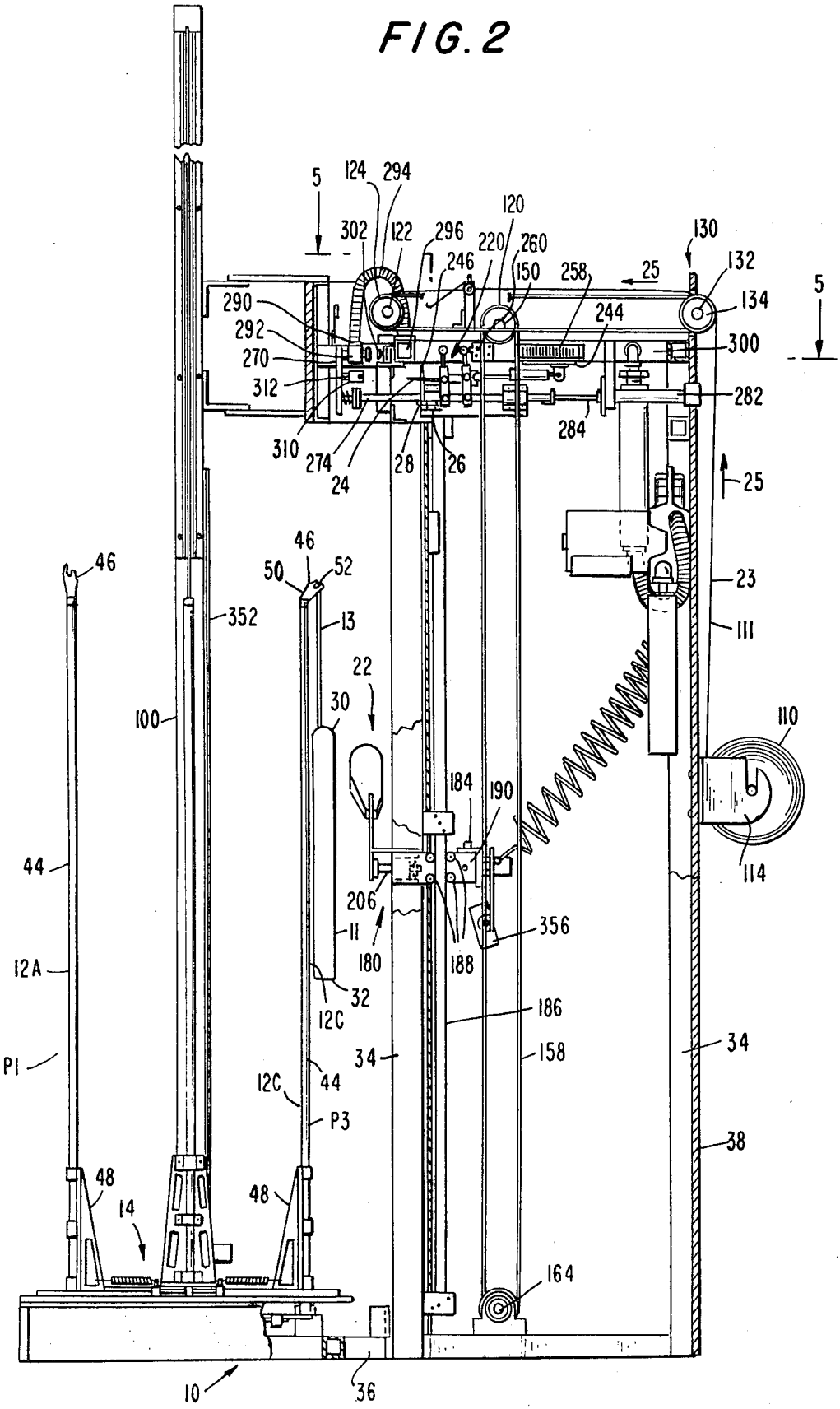
FIG. 2 is a side view of an automatic bagging machine.

As best seen in FIGS. 1 and 2, the present invention operates upon a garment 11 of a type which would be made by a garment manufacturer and which could be an item of men's wear, women's wear or children's wear. As will be seen hereafter, the garments 11 may be presented to the present apparatus in mixed fashion, that is, a number of men's garments, a number of women's garments and a number of children's garments, which are intermixed, and which are of various sizes, including lengths and widths. Each garment has been hung upon a hanger 13, of any standard type. For purposes to be explained later, each garment has an upper edge 30 and a lower edge 32.

Each garment 11 is operated upon by the present apparatus 10, having in general an internal frame 34 and a base 36. A housing 38 is fixed to the frame 34 and a base 36. The housing 38 is made up of a number of panels. A controller housing 42 for controller means, further described, is fixed to housing 38.

Referring now primarily to FIGS. 1–4, a turntable assembly 60 is provided upon which a number, and desirably four garment stands 12A, 12B, 12C, and 12D are fixed. Each garment stand includes an upright 44 (more fully described in U.S. Pat. No. 4,094,128), a hanger retention member 46 at its upper end and a bracket 48 at its lower and rigidly mounting the upright 44 on the turntable assembly. Each retention member 46 includes an upwardly slanting plate 50 having a mouth 52 formed at its uppermost portion. Although only one of the garment stands has been described in detail, they are all identical. As can be seen in FIGS. 1 and 2, the hook section of a conventional hanger 13 fits into the mouth 52 of the hanger retention member 46, with the garment 11 hanging from the hanger downwardly. Since the hanger retention member 46 is slanted, it holds the garment 11 hanging from the hanger 13 somewhat away from the upright 44. Further, the garment stands are each oriented so that the plate 50 at its upper end is in a plane running along a radius of the turntable hereinafter described, whereupon the stands hold their respective garments face outwardly of the turntable assembly 60, as seen in FIG. 2.

The apparatus 10 includes a turntable assembly 60, best seen in FIGS. 1 through 4, which enables garments on the stands to rotate through various positions. The turntable assembly 60 includes an upper turntable 64 having a central opening 66. The upper turntable 64 and the lower turntable 62 are joined for mutual rotation as hereinafter described. The upper turntable 62 has a number of slots 68, with each upright 44 of a garment stand passing through one slot. A turntable drive 70 is provided for rotating the turntable assembly 60. The drive may be of any conventional type, as shown in U.S. Pat. No. 4,094,128, and includes a air actuated drive cylinder 72 which causes the turntable 62 and 64 to rotate through sequential archs of 90° in a clockwise direction as indicated by the arrow A in FIG. 3.

Figure 3:
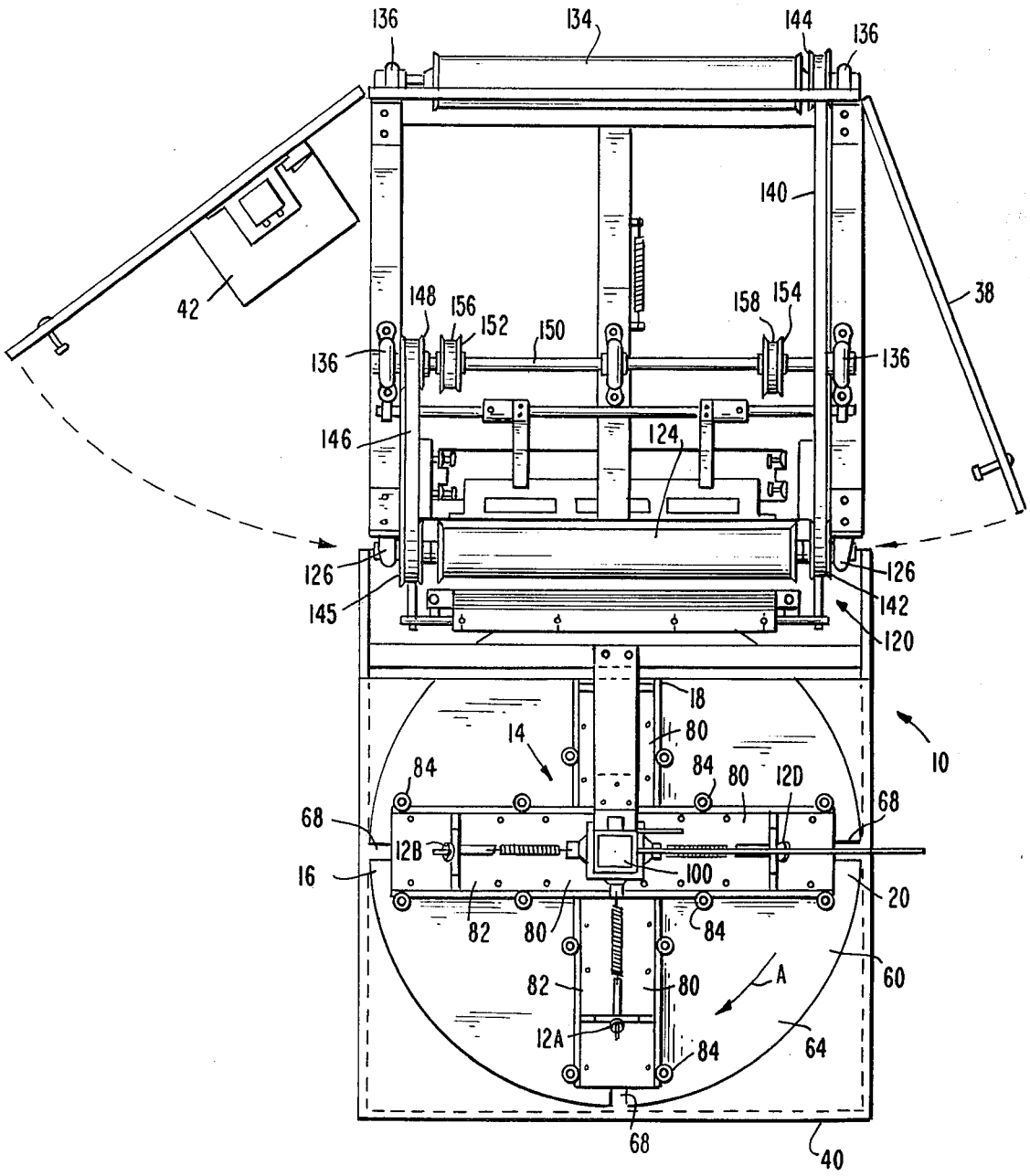
FIG. 3 is a top view of an automatic bagging machine.

Each garment stand 12A–12D is mounted upon a slide assembly 80, see FIGS. 1 and 3, which enables limited movement of the garment stand along a radius of the turntable assembly 60. Since the four slide assemblies 80 are identical, only one need be described. An assembly 80 includes a slide base 82 which reciprocates with respect to the upper turntable 64 with the four slide bases 82 being mounted 90° apart.

The slide base 82 may have a rectangular configuration and is carried by four freely rotating wheels 84. Each wheel 84 has a slot around its circumference for receiving the edge of the base 82. Wheels 84 support the base and allow it to easily reciprocate from its inner most retracted position, to its outermost extended position. A garment stand 12, as previously described, is mounted on and extends upwardly from the top face of base 82. A cylindrical element 88 extends from the bottom face of base 82 and includes a rotary bearing element 90 extending and rotably affixed to the cylindrical element 88. Each slide base 82 is biased toward a retracted position, that is biased towards a location central of the turntable assembly 60, by springs 92. The rear edge at the innermost end of the base 82 limits inward movement of the base 82. A projection 94 passes through the openings 63 and 66 and acts to both support a central pole 100 and to contact the rear edge of base 82 and limit the inward movement of each base.

Figure 4:
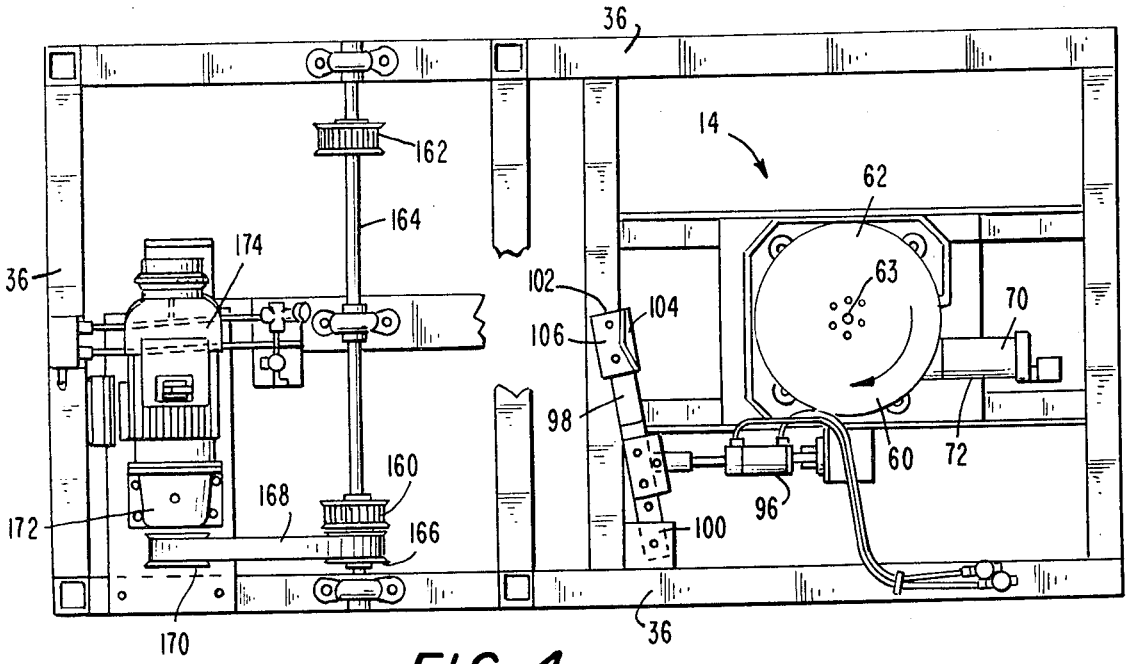
FIG. 4 is a top view of the base of the automatic bagging machine.

An air actuated cylinder 96 which is located below lower turntable 64, see FIG. 4, actuate a pivoted member 98 having a first end 100 pivotally connected to a base 36 and a swivel end 102 having an end member 104. The member 104 includes an open slot 106 which receives bearing element 90, as will be further described.

Cylinder 96 sequentially reciprocates each slide assembly 80. When a garment stand 12 is in the operative position at P1, it is moved into an alignment position P2 by the rotation of the turntable assembly 60 by the turntable device 70. Then the garment stand moves into position P3 by further rotation of the turntables 62 and 64. As the slide base moves into position P3, the rotating bearing element 90 moves into the slot 106 located in the end member 104 of the pivoted member 98. The actuator cylinder 96 causes the pivoted member 98 to pivot around end 100 and cause the end member 104 to move the bearing element and the attached slide base 82 to its outermost extended position. When the cylinder 96 is retracted, the slide base 82 is rapidly returned to its retracted position by the biased spring 92 with the rear edge stopped against projection 94. It should be noted, that the slide bases 82 are positioned so that two of the bases which are aligned with each other through an axis passing through the center of the turntables are on a different level than the other two slide bases which are aligned with each other through an axis 90° to the first axis. This overlapping provides a useful benefit in that it is desirable to have the rear edges of each of the slide bases engaging the projection 94. By making the projection 94 relatively small, the diameter of the upper turntable may also be somewhat smaller since the slide bases are able to come closer to the center of the turntable. However, in order that the slide bases remain in contact with all of the wheels 84 as the bases move to their most extended position, two of the bases must overlap the other bases.

The turntable drive 70, as previously described serves to intermittently drive the turntable assembly 60 through 90° arcs. The location of garment stand 12A as seen in FIG. 2, may be described as a loading station or position P1. When the turntable assembly is now rotated 90°, the stand at the loading station P1 is brought to an operative station or position P2, see 12B in FIG. 1. Upon the next rotation of 90°, the stand at position P2 moves to an intermediate aligned position P3, which is another 90° removed, and finally an additional 90° of arcuate movement brings the garment stand to its unloading station or position P4. It will of course be understood that each garment stand in turn rotates from position P1 through positions P2 and P3, to finally P4, and then returns to its initial position P1.

As best seen in FIG. 2, the apparatus 10 operates with a supply roll 110 of conventional and well-known tubular plastic transparent material 23. While rolled in the form of a supply roll 110, the tubular material is in the form of a flattened single plane web 111 but after the movement of this web through the apparatus, the web has opposed generally parallel broad faces, back face and front face, and a pair of opposed generally parallel sides, right side and left side as shown and further described in U.S. Pat. No. 4,094,128. The supply roll 110 rides upon a supply roll shaft 120 which is held by a pair of spaced brackets 114 fixed to a rear portion of the frame 34.

As the supply roll unrolls, as later described, and as the web 111 continues to move through the apparatus, it is guided in its path 25 of movement by conventional guide roll 116 which is attached to the frame 34.

Auxiliary drive means 120 is provided to aid in unrolling web 111 from the roll 110. This means includes an auxiliary drive shaft 122 carrying a roll 124, and journalled on a pair of brackets 126 fixed to the frame 34. Another auxiliary drive means 130 serving substantially the same function as means 120 includes an auxiliary drive shaft 132 carrying a roll 134, and journelled on brackets 136 fixed to frame 34. The rolls 124 and 126 are disposed transversely of the direction of movement of the web 111, and have an adherent surface which may be made up of any desired material such as polyurethane.

The rolls 124 and 126 are driven in one direction only, this being the direction of movement of the web 111, shown by the arrow B in FIG. 2. The rolls 124 and 134 are driven together by a drive belt 140 located between pulleys 142 and 144 on drive shaft 122 and 132 respectively. Another pulley 145 is also located on shaft 122 and is provided to turn the roller 124 by a drive belt 146 which is connected to a pulley 148 affixed to shaft 150. In order that the rolls only turn in one direction, a one-way clutch may be provided on shaft 150 so that pulley 148 will only turn in one direction.

A pair of pulleys 152 and 154 are connected to shaft 150 and receive drive belts 156 and 158 respectively. These two drive belts extend down to the base of the apparatus to turn pulleys 160 and 162 which are fixed to drive shaft 164, see FIG. 4. A drive pulley 166 is provided on one end of drive shaft 164 and has a drive element 168 which is turned by a pulley 170 provided on a gear box 172 driven by a motor 174. The gear box and motor are manufactured by Bauer in West Germany and have a reversing cycle operating at 2,000 cycles per hour. More details as to the operational sequence of the motor gear box will be further described.

Adjustable placing apparatus 22, seen in FIGS. 1 and 2, are provided to draw the lower most or the leading edge of the web 111 from a location above the stands to a position covering a garment supported by retention number 46. The placing apparatus 22 is carried by an elevator means 180 which includes a front piece 182 extending between the internal frame 34 and a rear cross member 184 also extending between the frame members. A pair of guide rails 186 (only one can be seen in FIG. 2) are connected to the internal frame and guide a set of four guide wheels 188 located on a carriage 190 which connects the front cross piece to the rear cross member 184. There is a carriage (not shown) corresponding to the carriage 190 which also carries four wheels and rides on the guide rails 186. The drive belts 156 and 158 are fixedly attached to the carriages whereby the drive belts 156 and 158 either elevate or descend the carriages depending on the direction of rotation of shaft 164.

The adjustable placing apparatus 22 includes a pair of gripping claws 190 and 192 which are intended to grip a side of the web 111 when the web is in the open position, with the left side gripping claws 192 intending to grip the left side of the web and the right side gripping claws 190 intending to grip the right side of the web. Each gripping claw includes an interior moving jaw 194 and 196 on which is mounted a pressure pad 198 and an exterior fixed jaw 200 and 202 which also have pressure pads 198. The pads 198 are provided to grip a side of the web with increased friction. The lower ends of the jaws 194 and 196 are mounted for relative pivotal movement. The lower end of jaw 194 is affixed to a shaft 206. The shaft is connected via a pivotally mounted hinge 208 which is in turn connected to an air actuated cylinder 210. The interior moving jaw 194 is driven towards and away from exterior fixed jaw 200 by air being supplied to the cylinder 210 in response to the controller system to be further described. The gripping claws 192 are substantially identical with the gripping claws 190 and therefore are not specifically described.

The apparatus 10 makes provision for operation on webs 111 of different widths. To this end, the distance between the gripping claws 190 and 192 is adjustable. The front cross piece 182 has a pair of aligned, spaced slots (not shown) formed therein. Each gripping claws 190 and 192 is connected by bolts 212 to the front cross piece through the slots. Therefore, when it is desired to move the gripping claws 190 and 192 either further apart or closer together, the bolts 212 are loosened so that the entire gripping claw unit can be moved either closer or further apart. When they have been placed in their proper desired locations, the bolts 212 are tightened again. The aforesaid adjustment is made so as to locate the gripping claws in alignment directly under the sides of the web when the web is in its opened condition. It should be noted that the hinge 208 includes a series of holes for connecting it to the cylinder 212 whereby additional adjustments may be made between the actuator and the gripping jaws.

Figure 5:
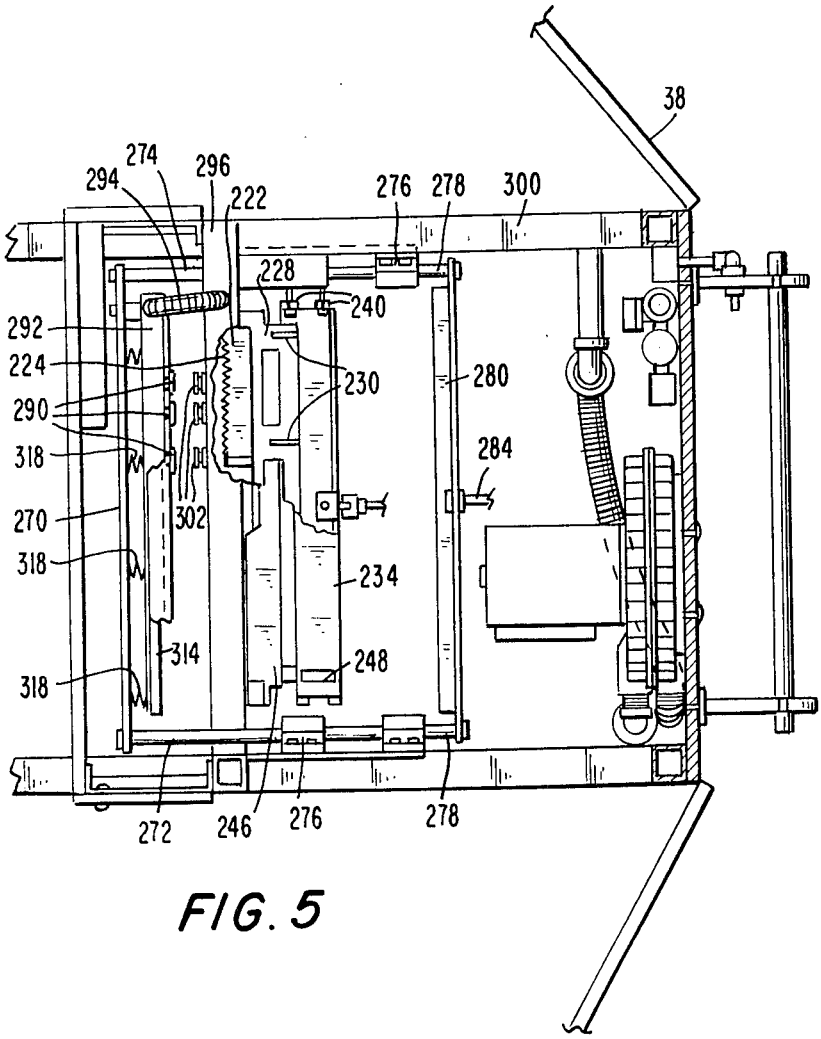
FIG. 5 is a view through 5—5 on FIG. 1.
Figure 6:
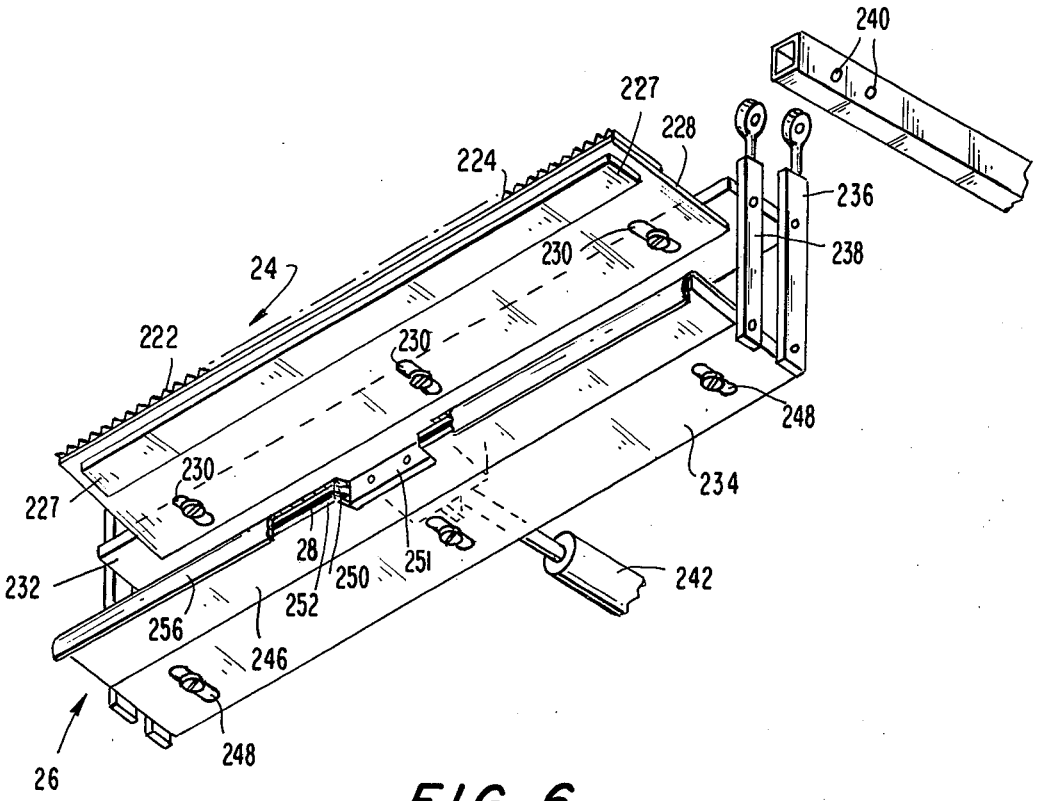
FIG. 6 is a plane view of the reciprocating actuator device.

A reciprocating actuator device 220, best seen in FIGS. 2, 5 and 6, is located along the path 23 of the web and includes both the cutting device 24 and the sealing device 26. The cutting device 24 includes an elongated cutting blade 222 which terminates in a series of saw blade teeth 224. The blade 222 has a length somewhat greater than the web 111. The blade 222 is affixed to a carrier member 232 by a bracket 228. A series of groove 230 are provided on the bracket 228 so as to allow adjustment of the cutting blade 222 with respect to the carrier plate 226. Two rubber strips 227 are attached to bracket 228 along both sides of blade 222.

The carrier device is comprised of two carrier members 232 and 234 which extend transversely across the path of the web and are pivotally connected to two substantially identical pairs of pivot members 236 and 238 at either end of the carrier members 232 and 234.

The pivot connection permits relative movement between the pivot members and the carrier members. The pivot members 236 and 238 are also typically connected at points 240 to the frame of the apparatus as illustrated in FIG. 6. An air actuating cylinder 242 is attached to the carrier member 232 to move the carrier device towards and away from the material passing over a garment in the front of the apparatus. A plate 244 attaches the cylinder to the frame as shown in FIG. 2. Slots (not shown) are provided in the plate 244 so that the cylinder may be moved either towards or away from the front of the machine to adjust the carrier device to a desired position.

The sealing device 26 is fixed to the carrier device as best seen in FIG. 6. More specifically, the sealing device includes a sealing bar 246 which is adjustably connected to the carrier member 234 via the grooves 248 located in the carrier member. The sealing bar 246 includes a groove 250 divided into two sections by a cut out 251 and extending along the front edge 252 of the sealing bar 246. A sealing element 28 comprised of two flat inductive wires such as for example, a Nicad wire is provided in groove 250 such that it does not extend beyond the front edge 252 of the sealing bar. The important characteristic of the sealing element is its ability to both heat and cool very rapidly. A non-stick surface 256 which may be comprised of material having a non-adhesive quality such as for example, teflon cloth, is placed across the front edge 252 of the sealing bar 246 so as to cover the groove 250 and not permit contact of the element 28 with the web as will be further explained.

The wire 28 and the sealing bar are connected to a plurality of resistors 258 through which power is delivered to the wire 254. A micro-switch 260 as seen in FIG. 2, is mounted on the frame 34 in a position whereby complete retraction of the carrier member 232 closes the micro-switch. In this closed position, power from a transformer (not shown) passes through the resistors which may be for example, a series of seven parallel resistors each having a value of approximately 2.5 ohms and then to the sealer element 28. Since a low amount of power goes to element 28, it is at a substantially lower temperature than necessary to seal the bag material. When the carrier member 232 moves forward, the switch 260 opens and power short circuits the resistors and passes from the transformer directly into the wire 28 causing the latter to heat up to a sealing temperature very quickly. Thus, it can be understood that the wire 28 is only heated as required. Therefore there is a significant reduction in operating costs as well as a decrease in the heat created by the sealing element. The result is a reduction of wear on the sealing element and prevention of expensive replacement procedures as the element wears out.

A reciprocating structure 270, as seen in FIG. 5, is moved by two guide rails 272 and 274 which extend toward the rear portion of the apparatus and are carried through guide supports 276. The guide supports are joined at their ends 278 by a cross member 280. The entire structure 270 is reciprocated forward away from the front of the apparatus and rearward towards the sealing and cutting elements by an air actuated cylinder 282 as seen in FIG. 2. The cylinder is fixed to the cross member 280 by actuator rod 284.

A series of suction cups 290 are provided along the structure 270 on a vacuum tube chamber 292. The suction cups draw in the web separate the two sides of the material as it passes between the structure 270 and the reciprocating actuator device 220. The vacuum tube chamber 292 has a vacuum pressure from tube 294. The latter is connected to a hollow support frame member 296 which has a vacuum therein created by a vacuum pump 298. Pump 298 also serves to provide air to the air actuated devices on the apparatus. The vacuum pump 298 creates a vacuum pressure inside hollow frame member 300 which in turn is connected to the frame member 296. Also, along the front side of frame member 296 are a series of suction cups 302 which are aligned with the suction cups 290 on the tube chamber 292. The two sets of suction cups 290 and 302 act in conjunction with each other. When the support element 270 moves away from the support frame member 296, the suction cups grip the material and cause the two sides of the web material to separate. This allows the gripping claws 190 and 192 to grab the two sides of the web and pull it down as will be further described.

A support member 310 is provided below the tube chamber 292 and extends transversely across the width of the support element 270. The support member 310 has an elongated groove 312 extending along its length and sized to receive the cutting blade 222 as will be further described. In addition, the front face of the support member 310 is located so that the two strips of rubber which are provided along both sides of the cutting blade are pressed against the front face of the support member 310. The web material between the support members and the rubber strips 227 is held in place when the cutting blade enters the groove as will be further described.

Two pressure pads (only one of them, 314 can be seen in FIG. 5) are connected below the support member 310 on the reciprocating structure 270 as best seen in FIG. 2. The pressure pads are each mounted on a pair of coil springs 318 and separated by a space between the ends of the pads. The pressure pads 314 and 316 face the sealing device 26 so that when the reciprocating actuator device 220 moves forward, the web material will be pressed between the pressure pads 314 and 316 and the non-stick surface 266 of the sealing bar 246. A significant advantage is achieved by the arrangement of the reciprocating actuator device being placed opposite the support element 270. As the air actuating cylinder 242 moves the reciprocating actuator device forward towards the front of the apparatus, the pivot members 236 and 238 pivot about pivot points 240 causing the carrier members 232 and 234 to move forward and upward. Simultaneous with this movement, the reciprocating structure 270 is moved by the air actuated cylinder 282 towards the reciprocating actuator device. The cutting blade 222 enters groove 312 in the support member 310 and rubber strips 227 press the material against the front face of member 310. Since the blade is moving forward and upward it causes a more positive and even cut in the plastic material. At substantially the same time that the aforesaid severance of the web is effectuated, the web is also heat sealed so as to form a heat seal line immediately below the line of severance. To this end, the wires 254 are heated and the material is pressed between the non-stick surface 256 and the pressure pads 314 and 316. Since there is a space between the two pressure pads 314 and 316, no sealing occurs between the two pads. An opening is thereby provided in the top of bag through which the hook of a hanger may freely pass.

Having now described the mechanical components of the automatic bagging apparatus 10, its operation will be generally outlined. The overall cycle including the electronic control device is described in U.S. Pat. No. 4,094,128 and the present invention maintains that general configuration and operation described in the referenced patent.

A garment 11, carried by a hanger 13 is placed on the hanger retention member 46 of a garment stand 12A located at the loading position P1. The garment may be placed at the loading position by a appropriate apparatus (not shown) or even by hand. The controller housing 42 wherein the electronic controlling device is located, energizes the actuator 72 to cause the stand with the garment at the loading position P1 to move to the operative position P2 (indicated by 12B in FIG. 1). The stand 12 is moved from the loading position to the operative position P2 through an arch of 90° by the turntable drive 70 which rotates the loader turntable 64 in the clockwise direction indicated by the arrow A in FIGS. 3 and 4.

Although the present invention is not concerned with many aspects of the apparatus 10, as they were shown and fully described in U.S. Pat. No. 4,094,128, it is important to mention a few details in order to further understand the operation of the apparatus as will be described. A central pole 100 is attached to the center of the upper turntable 62 and has a projection 94 which fits through the central opening 66 to provide a stop member for the slide base elements 82. A reflecting surface 352 is located on one side of the central pole opposite an open slot (not shown) along the length of the front of the cabinet which covers the internal frame of the apparatus. This opening provides a space for a photo cell 356 to shine a light beam on the reflecting surface 352 which is detected by a detector associated with the photo cell.

Before the turntable rotates the full 90° to an aligned position P3, the presence of the garment moving from the operative position P2 is sensed. This is caused by the garment interrupting the light path between the photo cell 356 and the reflecting surface 352. This interruption is detected by a detector associated with the photo cell. Since the interruption of the light path occurs when the outer edge of the garment breaks the path, and before the turntable has indexed its full 90°, the turntable continues to rotate in the clockwise direction without any other operations commencing. The completion of the indexing is sensed by the detector.

At this point, the rotable bearing element 90 has entered into the slot 106 in the second end 102 of the pivoted member 98. The air actuated cylinder 96 drives the pivoted member 98 towards the back of the apparatus and the end member 104 pushes the bearing element 90 against the bias of spring 92. As a result, the stand 12A is moved from the operative position P2 to an aligned position wherein the garment 11 is located on the stand beneath the path of the web 111.

With the stand at the aligned position P3, the jaws 190 and 192 are at there uppermost position (not shown) and both the right gripping claws 190 and the left gripping claws 192 close. The controller 42 causes the air cylinder 210 to operate to pivot the interior jaws 194 and 196 so that the sides of the web are gripped between the pressure pads 198.

With the left gripping claw 192 engaging the left side of the web and the right gripping claw 190 gripping the right side of the web, the controller causes the motor 174 to operate in a direction to lower the grippers. Motor 174 turns gear box 172 and moves drive element 168 and the drive belts 156 and 158 so that elevator 180 moves downward. As the elevator 180 is lowered, the gripping claws pull the web 111 downwardly over the garment.

Actuation of the drive elements in a direction to lower the elevator also transmits movement to the drive belt 146 and 140 located near the top of the apparatus. This causes the rolls 124 and 134 to rotate whereby the web moves in the direction of arrow B shown in FIG. 2. Since tension is being applied to the web 111 as a result of the downward pulling action of the gripping claws, the web is pulled against the adherent surface of the rolls 124 and 134 enabling the drive element to assist in supplying the tubular material from the roll 110 located at the rear of the apparatus. The gripping claws begin to move downwards and eventually reach a level where the photo cell 356 (attached to the bottom of the rear cross member 184) detects the bottom end of the garment. Thus, the claws pull down a length of material depending upon the length of the garment. The lower edge of the material is still above the bottom of the garment; continued downward movement of the material occurs subsequently as will be explained. The material is now held stationary i.e. the motor does not continue to turn, so that the material can be cut and sealed.

When the rotable bearing element 90 enters the slot 86 as previously mentioned, the air actuating cylinder 242 moves the reciprocating actuating device 220 towards the path of the web passing in front of the apparatus and at the same time, the air actuated cylinder 282 pulls the reciprocating structure 270 towards the path of the garment. As the actuator device 220 begins to move forward, the micro-switch 260 closes and allows current to bypass the parallel resistors 258 and go directly into the wire 254 so as to quickly raise the temperature of the Nicad wire to approximately 400° to 500° F. When the cutting blade 222 moves into the groove 312 of the support member 310 and severs the material, simultaneously the non-stick surface 256 of the sealing bar 246 presses the tubular material against the pressure pads 314 and 316 and seals the two faces of the web together. The seal formed by this process is very strong. The cutting and sealing occurs when the gripping claws 190 and 192 have reached the first stopped position above the bottom of the garment.

After the cut has been made and the seal is formed the controller 42 causes the cylinder 282 to retract the structure 270 and the controller 242 to retract the actuator device 220. During the retraction of the two assemblies, the vacuum cups 302 and 290 separate the tubular material for the next cycle.

After the cutting and sealing devices 23 and 26 have cut and sealed the web, the controller causing the gripping claws 190 and 192 to move downward yet further, and the now formed bag is pulled down from the cut line until the sealed line rests on the upper edge of the garment, enabling both the hanger hook and the hanger retention member 46 of the stand to pass through the hanger opening in the tubular material. The controller 42 then deenergizes the actuator cylinders 210 to open the jaws of the gripper claws so that the bottom edge of the bag is released. It is to be noted that after the web is cut, further downward movement of the claws will not cause the rolls 124 and 134 to supply additional material since there is no tension on the web around the adherent surfaces of the rolls. The gripping claws continue to move downward slightly so that they clear the bottom of the formed bag.

The controller then causes the air actuated cylinder 96 to retract the pivoted member 98 so that the slide base 82 carrying the stand 12A moves quickly under the influence of the spring 92 back against the projection 94.

Motor 174 now rotates in a direction to raise the gripping claws with the claws being raised until they have reached a position between the open cutting and sealing devices. It should be noted that the movement of the claws in the upward direction does not result in rotation of the rollers 134 and 124 due to the provision of a one-way clutch on shaft 150.

After the garment stand has returned to its aligned position P3, the controller 43 indexes the garment stand to the position P4 and, assuming that another garment is now presented at the operative position, the cycle is repeated with the garment which is now at the operative position having the web pulled over it when it is shifted to the aligned position. After this garment has been bagged, the turntable is rotated another 90° so that the garment stand of the first or earlier bagged garment moves from the aligned position P3 to the unloading position P4. At this position, a lifting assembly, as described in U.S. Pat. No. 4,094,128, operates on the first bagged garment to remove it from the stand and transfer it to the storage area.

While there has been described what is at present considered to be the preferred embodiment of the invention, it will be obvious to those skilled in the art that various changes and modifications may be made therein without departing from the invention, and it is, therefore, aimed in the appended claims to cover all such changes and modifications as fall within the true spirit and scope of the invention.

What is claimed is:

1. Apparatus for automatically forming bags on hanger suspended garments comprising;

a. a plurality of stands for supporting hangers with garments suspended therefrom, b. means for moving each of said plurality of stands in sequence to at least first, second and third positions, each of said stands remaining stationary for a brief interval at each of said positions following its arrival thereat, each of said stands being adapted to have a hanger suspended garment mounted thereon when said each stand is at said first position, c. adjustable placing means at said second position for pulling down tubular material along a path, d. cutting means above the garment moving towards the material to cut the tubular material, and away from the material to permit pulling down of additional tubular material, said cutting means includes a cutting blade extending transversely across said path, and means comprising rubber strips extending along the side of the cutting edge and rearwardly of the cutting edge for pressing against and holding said material so that the material is more evenly cut;

e. sealing means above the stands moving toward the material to seal the tubular material and away from the material to permit pulling down of additional tubular material, said sealing means including a sealing element means and means to heat said sealing element means to a heat sealing temperature during the movement toward the tubular material to seal the tubular material and to a lower non-sealing temperature during movement away from the material.

2. The apparatus as defined in claim 1, wherein said sealing means includes a non-stick surface extending transversely across said path and covering said sealing element means for engaging the tubular material when it is being sealed and pressure pad means for pressing the tubular material against the non-stick surface when said sealing element means contacts the material to form the seal.

3. The apparatus as defined in claim 2, wherein said non-stick surface is a plastic cloth material for preventing the tubular material from touching and sticking to the sealing element means.

4. The apparatus as defined in claim 3, wherein said sealing element means includes an elongated wire extending transversely across the path of the tubular material.

5. The apparatus as defined in claim 4, further characterized in that said sealing element means receives electric current from a plurality of resistors and a switch means connected in parallel to each other and a switch means for delivering current to the sealing element means whereby current passing through said plurality of resistors when the switch means is open heats the elongated wire to the lower non-sealing temperature and electric current passing through the closed switch means which causes said plurality of resistors to be shorted out heats the elongated wire to the heat sealing temperature.

6. The apparatus as defined in claim 1, further characterized in that a reciprocating structure means extends transversely across said path and moves towards and away from said material to co-act with said cutting blade.

7. The apparatus as defined in claim 6, further characterized in that the reciprocating actuator means coarries said cutter blade and said sealing means for simultaneously cutting and sealing said tubular material when the actuator means moves forward toward the material.

8. The apparatus as defined in claim 6, further characterized in that said reciprocating structure means has a support member with an elongated groove for receiving said cutter blade, said rubber means including strips of rubber which press the material against the support member as the blade enters the elongated groove.

9. The apparatus as defined in claim 8, further characterized in that said reciprocating actuator means includes a pivotal connection between said apparatus and said cutting blade and said sealing means whereby forward movement of said actuator means causes said cutting blade to simultaneously move upward and forward into said groove to positively cut said material.

10. The apparatus as defined in claim 9, further characterized in that said reciprocating actuator means includes an adjustably mounted actuator device for adjusting the forward movement of said cutting means and said sealing means.

11. The apparatus as defined in claim 10, further characterized in that said reciprocating structure means carries said support member, pressure pad means for pressing the tubular material against the non-stick surface and a vacuum bar for opening said tubular material, said reciprocating structural means simultaneously moves towards and away from said reciprocating actuator means as said actuator means moves toward and away from said material whereby the material is clamped between said reciprocating structure means and said reciprocating actuator means.

12. The apparatus as defined in claim 1, further characterized in that said adjustable placing means includes means for gripping the leading end of the tubular material and means for moving the gripping means between a position above the garment to a position below the lower end of the garment.

13. The apparatus as defined in claim 11, further characterized in that said adjustable placing means includes means for gripping the leading end of the tubular material and means for moving the gripping means between a position above the garment to a position below the lower end of the garment.

14. The apparatus as defined in claim 13, further characterized in that said gripping means includes a pair of gripping claws, a bar having a mounting slot, two reciprocating actuators affixed to said bar, each operating one of the pairs of gripping claws, means for mounting the gripping claws on the bar so that they grip the material at opposite ends thereof and maintain the leading end of the tubular material in an open condition.

15. The apparatus as defined in claim 14, further characterized in that said claw mounting means adjustably mounts the gripping claws in any desired position in the mounting slot so that the gripping claws can grip tubular material of different widths.

16. The apparatus as defined in claim 15, further characterized in that said means for moving gripper means includes a power operated drive shaft means alternating the direction of the rotation, a first rotating shaft means parallel to said bar and said drive shaft means, a second rotating shaft means above and parallel to said first rotating shaft means, a first drive belt between said drive shaft means and said first rotating shaft means for rotating said first shaft means in two directions, a second drive belt between said first and second shaft means connected to said bar whereby alternating rotation of said first rotating shaft means causes said bar to move up and down between a position above the garment to a position below the lower end of the garment.

* * * * *